United States Patent [19]

Watts

[11] 4,153,098

[45] May 8, 1979

[54] STRAIN REDUCTION OR REVERSAL TECHNIQUE FOR CONTINUOUS CASTING OF METALS

[75] Inventor: Leonard Watts, Jamaica, N.Y.

[73] Assignee: Technicon Instruments Corporation, Tarrytown, N.Y.

[21] Appl. No.: 699,750

[22] Filed: Jun. 24, 1976

[51] Int. Cl.[2] ..... B22D 11/00

[52] U.S. Cl. ..... 164/83; 164/416; 164/440

[58] Field of Search ..... 164/82, 83, 260, 274, 164/281 H, 416, 440; 74/54

[56] References Cited

U.S. PATENT DOCUMENTS

| | | | |
|---|---|---|---|
| 777,561 | 12/1904 | Stravs et al. | 164/274 |
| 3,814,166 | 6/1974 | Watts | 164/83 X |
| 3,850,225 | 11/1974 | McNitt et al. | 164/274 X |
| 3,857,437 | 12/1974 | Watts | 164/83 |

*Primary Examiner*—Richard B. Lazarus
*Attorney, Agent, or Firm*—S. P. Tedesco

[57] ABSTRACT

Strain reduction or reversal technique for continuous casting of a metal billet element wherein there is provided an axial mold wall which is oscillatable, a plug element in the axial wall which may be solid in the sense that it closes one end of the mold or which may be of a type in which molten metal may flow therethrough into the mold, one of said elements being oscillatable with respect to the axial wall in a manner to relieve strain on metal newly freezing to the axial wall during oscillation of the axial wall.

12 Claims, 20 Drawing Figures

76
56
80
66
10a
69
57
58
72
68
60
74
78
Y 56
76
80
66
10a
69
57
78
72
68
60
74
Z
Z'

STRAIN REDUCTION OR REVERSAL TECHNIQUE FOR CONTINUOUS CASTING OF METALS

This invention relates to continuous casting of the type utilizing an oscillatable mold for metals which may have relatively high melting points such as iron, steel and its alloys, but is not limited to use of such metals.

It is known in the prior art to oscillate such a mold during a casting operation to reduce the risk of hot tearing of newly freezing metal against the axial wall structure of such mold, that is, it is known to oscillate either the mold axial wall, or to oscillate the entire mold wherein the mold has a bottom wall integral with the sidewall structure thereof as in my U.S. Pat. No. 3,517,725. Also it is known, as disclosed by O. A. Shatagin *Ivzest. VUZ - Chern Met.* pp. 58–63, February, 1964, to continuously cast metal utilizing an open-ended mold and a tundish which is fixed to the mold and oscillated therewith during the casting operation. Further, it is known, as disclosed by U.S. Pat. No. 3,642,058, to continuously cast such metals utilizing an open-ended stationary mold in which the casting is withdrawn from the exit end of the mold in increments. The last-mentioned patent discloses a stationary mold having a taper opening in the casting direction. It is also known to provide an oscillatable mold either with or without an end plug or wall having an axial taper opening in the casting direction as disclosed by my U.S. Pat. No. 3,857,437.

In such continuous casting techniques and apparatus, difficulty has been encountered in the casting operation in the imposition of strain or tension on the metal from the source of supply which is freezing on the axial mold wall during oscillatory movement of the axial wall. The present invention contemplates overcoming these difficulties.

One object of the invention is to provide improved apparatus and method for continuously casting metals utilizing an oscillatable mold which may be open-ended with a plug in the form of a tundish nozzle therein or closed at one end by a wall or plug. A further object of the invention is to provide for relief of strain on metal newly freezing on the axial wall of the mold while such wall is in an oscillatory movement. Still another object of the invention is to provide an axial mold wall which is oscillatable, a plug element in the axial wall which may be solid in the sense that it closes one end of the mold or which may be of a type in which molten metal may flow therethrough into the mold, the billet element being formed within the mold, one of said elements also being oscillatable with respect to the axial wall in a manner to relieve strain on metal newly freezing to the axial wall during oscillation of the axial wall.

Figure 1:
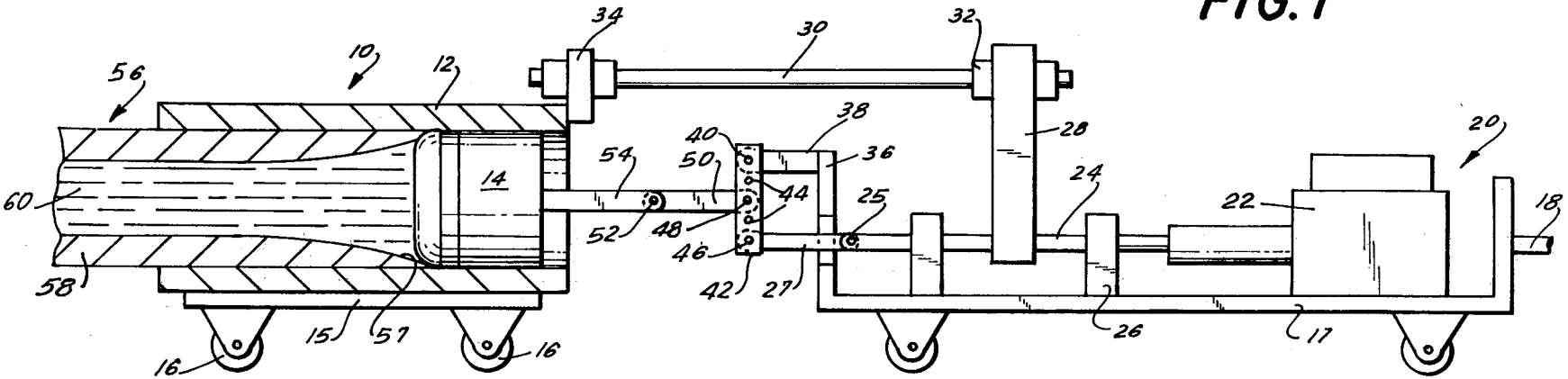
FIG. 1 is a fragmentary, side elevational view illustrating apparatus embodying the invention and showing the same during the continuous casting of metal.
Figure 6:
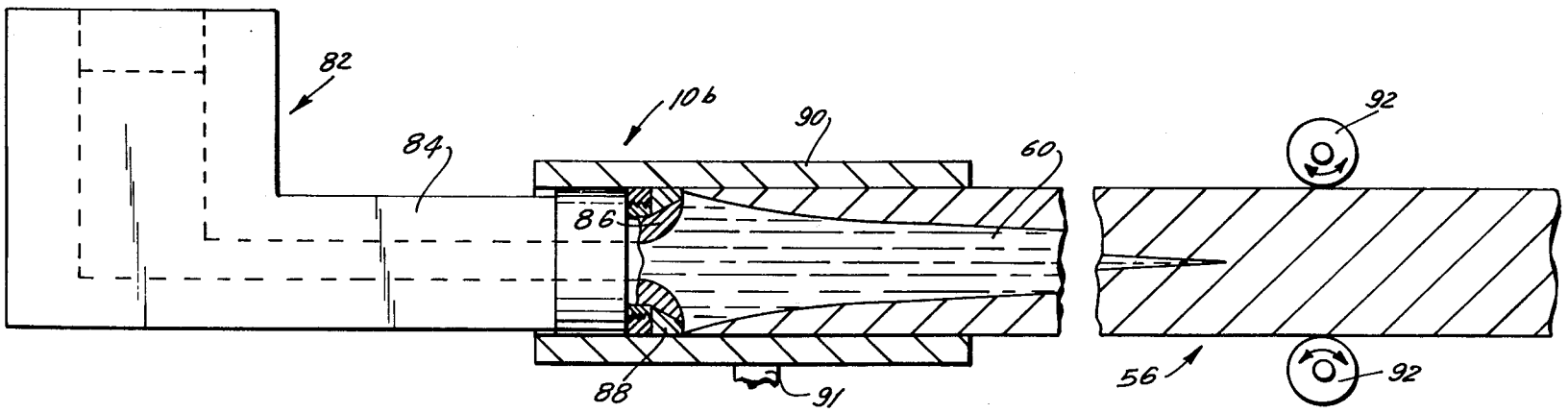
Figures 3A, 3B, 3C, 3D:
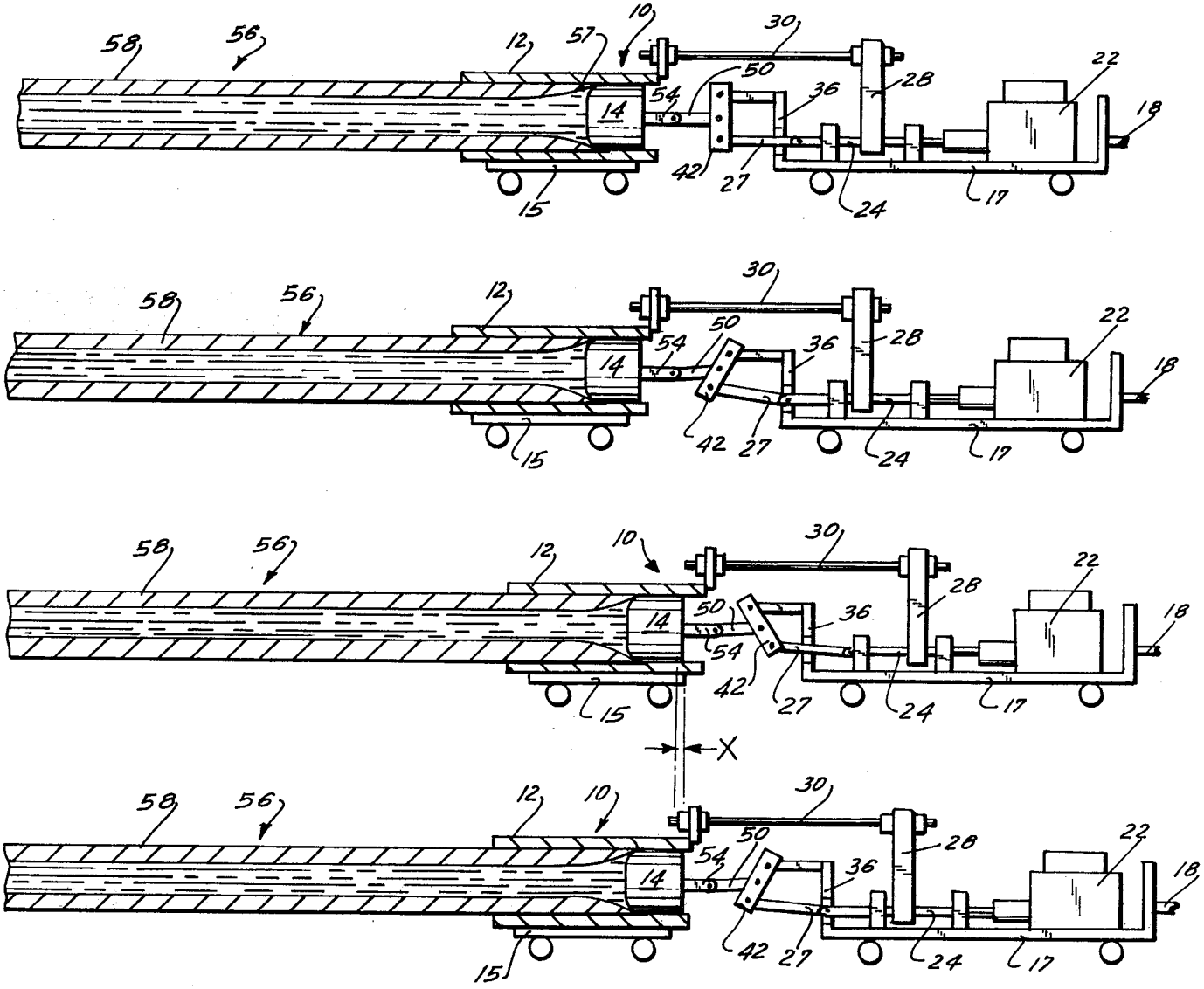
FIGS. 3A–3D are similar to views 2A–2D, respectively, but illustrating a different mode of operation of the apparatus of FIG. 1.
Figures 4A, 4B, 4C, 4D:
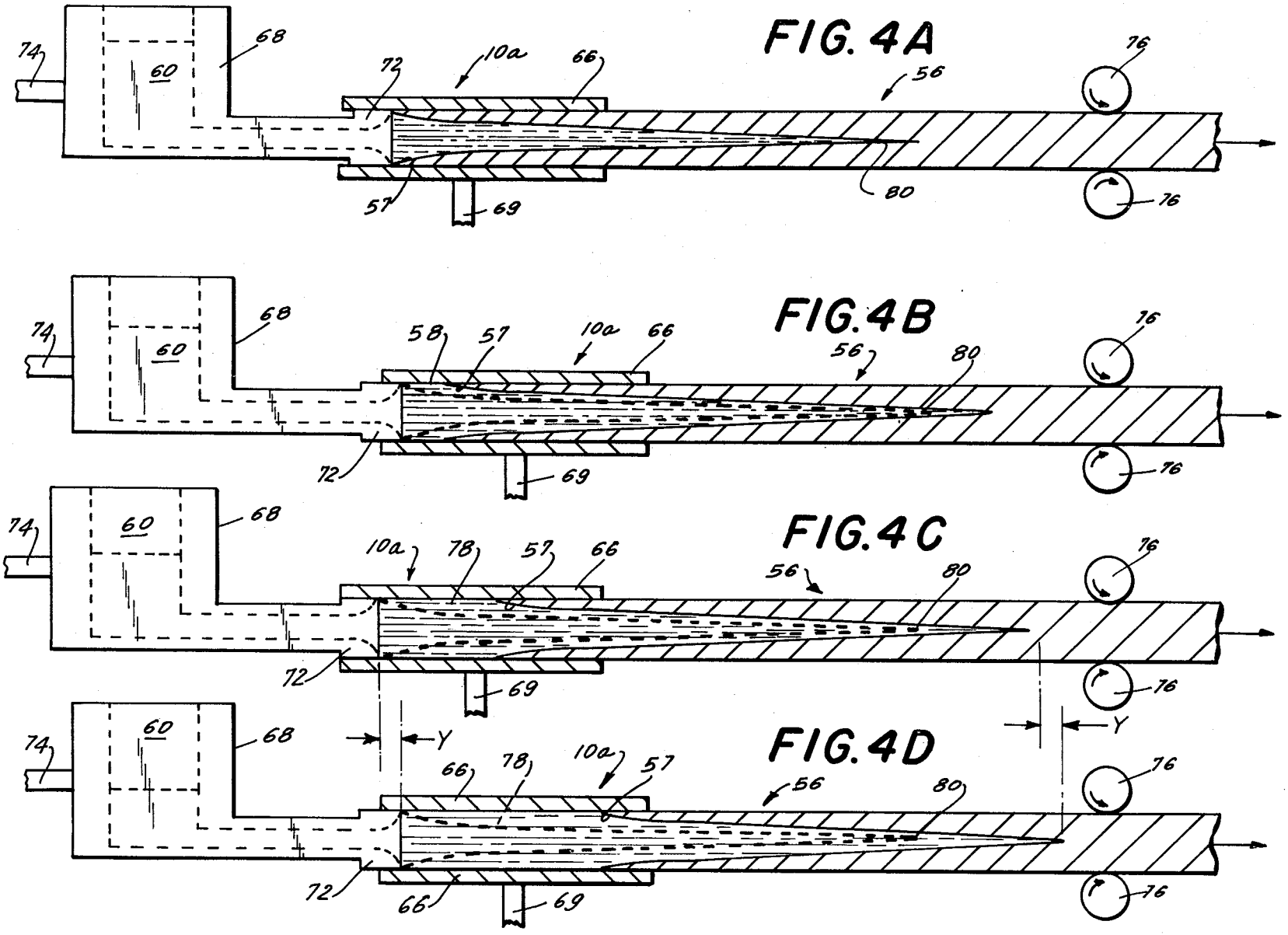
FIGS. 4A–4D illustrates a modified form of the invention and stages of operation of such apparatus corresponding to the stages shown in FIGS. 2A–2D, respectively.
Figures 5A, 5B, 5C, 5D:
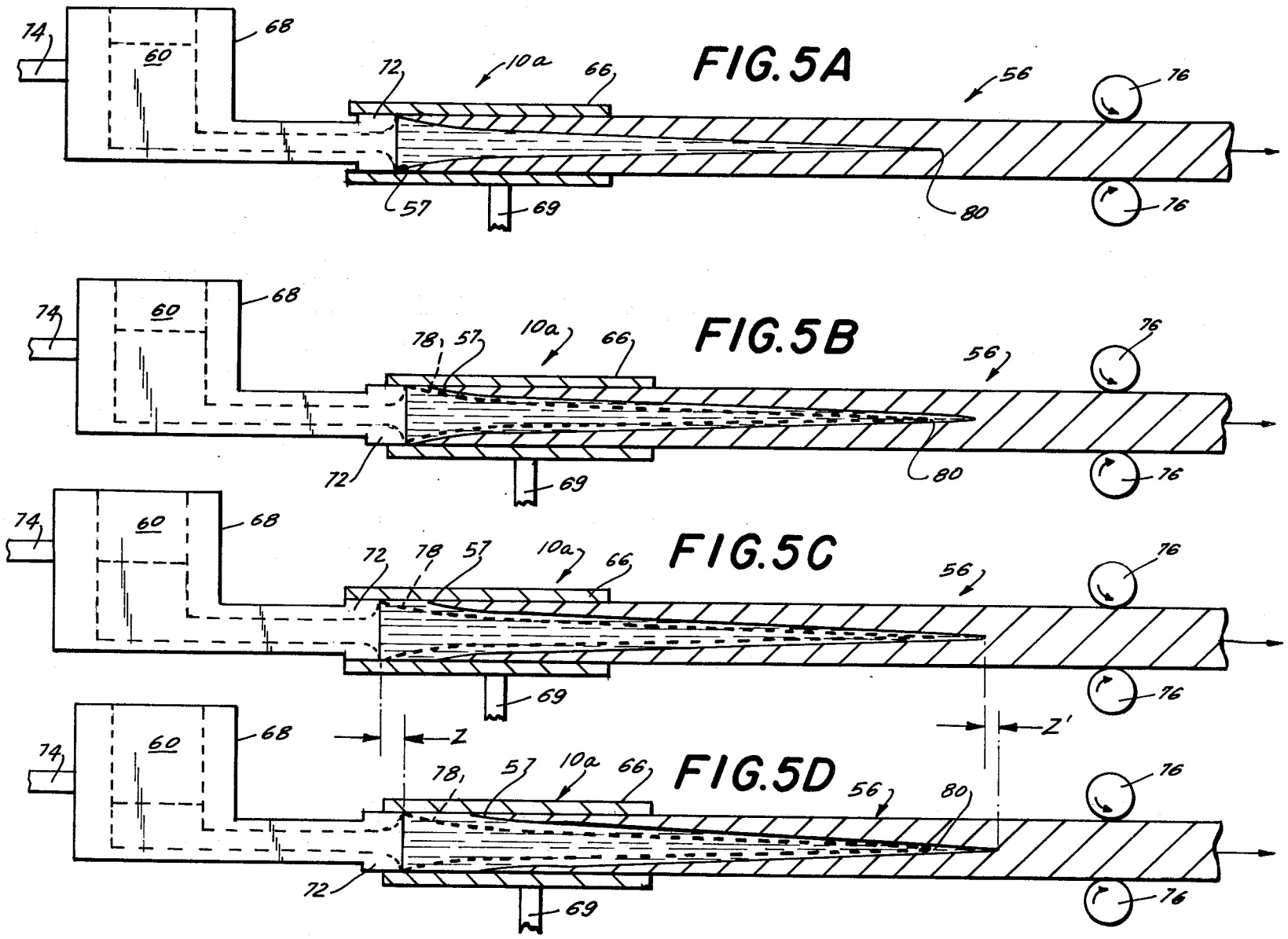
Figure 7:
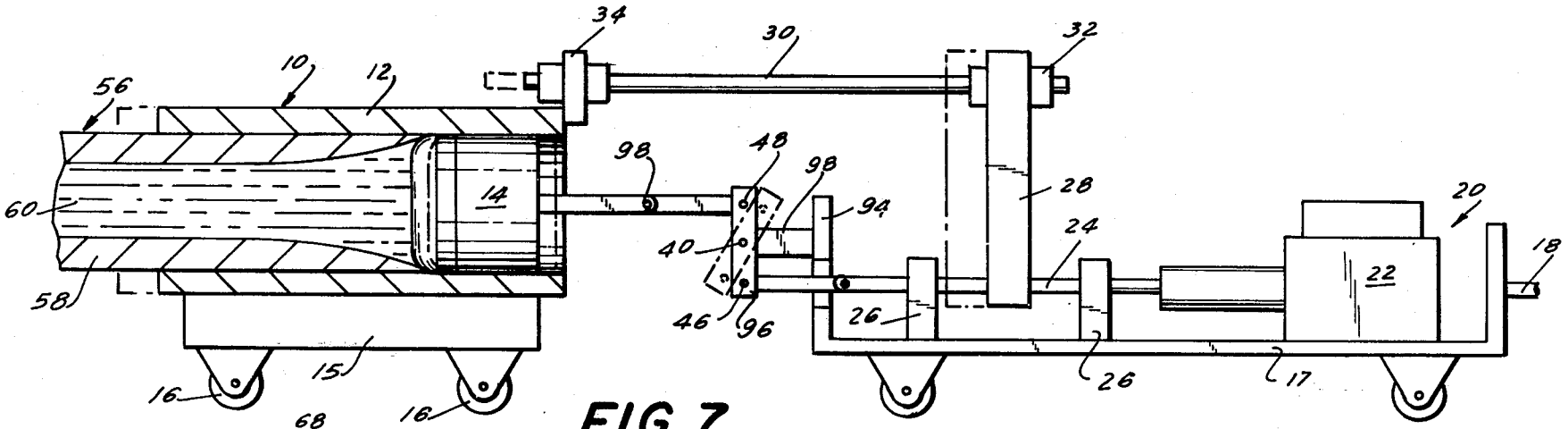
Figure 8:
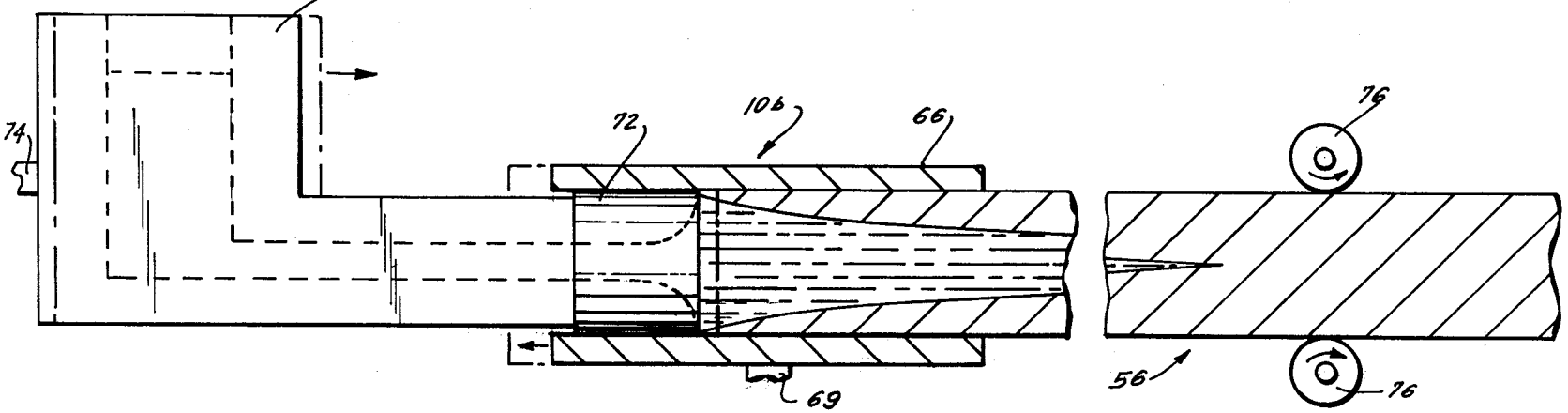

FIGS. 5A–5D correspond to FIGS. 3A–3D, respectively, with reference to stages of operation but illustrate the apparatus of FIG. 4A;

FIG. 6 is in a view similar to FIG. 1, illustrating another modified form of the invention;

FIG. 7 is a view similar to FIG. 1 illustrating a further modified form of the invention; and FIG. 8 is a view similar to FIG. 4A illustrating a further modified form of the invention.

In the form of the invention shown in FIG. 1, there is provided a nonillustrated source of molten metal, such as a tundish for example, which supplies molten metal to a mold indicated generally at 10, having an axial wall 12 chilled in a conventional nonillustrated manner, the mold 10 being closed at the end thereof remote from the tundish by a wall or plug 14 which may be constructed in accordance with the teaching of my U.S. Pat. No. 2,965,965, except that, in the present instance, the plug 14 is not stationary. The mold 10 is supported on a carriage 15 for relative separating movement from the molten metal source, as on wheels 16.

The carriage 15 is drawn in a direction relatively away from the molten metal source or away from the casting direction by a similar carriage 17 which is drawn in the last-mentioned direction through a bar 18. Provided on the carriage 17 is a prime mover, indicated generally at 20, the motor of which is indicated at 22 and shown for rectilinear driving movement of a piston rod 24. The piston rod is stepped longitudinally as indicated in FIG. 1 and is supported by a pair of supports 26, through which the piston rod 24 extends, fixedly supported from the carriage 17. Fast on the piston rod 24 is a flange 28, which near its radially outer margin is provided with a plurality of arcuately-spaced threaded tie bars extending therethrough and each having one end fixed thereto as by nuts 32, one such tie bar being indicated at 30. The other end of the tie bar 30 is secured in a similar fashion to a radial flange 34 provided on the axial mold wall 12 as shown. The carriage 17, at the end thereof nearest mold 10, is provided with a generally upright standard 36 having a clearance hole for the piston rod 24, and having at its upper extremity and fixed thereto an arm 38 projecting toward the mold 10 and having at its distal end a pivot 40 pivoting to the arm 38 one end of a link 42. The link 42 has a series of longitudinally-spaced pivot holes 44 therethrough extending from the pivot 40 toward the other end of the link 42. The last pivot hole is provided with a pivot 46 connecting the link 42 to the one end of link 27 the other end of which is pivoted by pivot 25 to the distal end of the piston rod 24. Connected to the link 42 through any selected one of the intermediate pivot holes 44 by a pivot 48 is one end of a link 50, the other end of which is pivoted at 52 to a stud 54 projecting from the plug 14 in fixed relation to the rear portion thereof. The closer the pivotal connection through the pivot 48 is to the pivot 46, the longer the stroke of the plug. Conversely, the farther the pivotal connection of pivot 48 is to the pivot 46, the shorter the throw of the plug 14.

As shown in FIG. 1, the billet, indicated generally at 56, which has one end thereof, not shown, affixed to a molten metal source such as a tundish in a now-conventional manner, has an outer shell or skin 58 of solidifying metal and a molten inner core 60 flowing toward the mold 10. The tundish may be similar to the tundish 68 of FIG. 4A. As shown in FIG. 1, the solidifying skin or shell 58 of the casting has a rear end which is thinnest near the plug 14 and increases in thickness in the casting or forward direction toward the molten metal source. The initial rear end of the shell is indicated at 57 in FIGS. 1 and 2A. The cross-sectional shape of the axial mold wall 12 may be circular, rectangular or any desired cross-section. As shown in FIG. 1, the mold wall 12 and the plug 14 are intermediate their extreme forward and rear oscillatory positions, with the link 42 in a plane normal to ground, not shown.

Figure 2A:
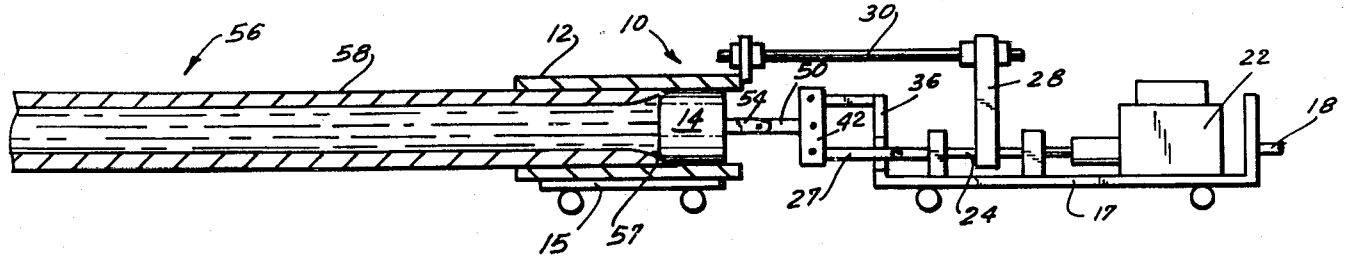
FIG. 2A is a similar fragmentary, schematic view illustrating a starting point for the description of one mode of operation of the apparatus of FIG. 1, the starting point not being shown at the initiation of the casting operation but at an arbitrary fixed point during the casting of the metal.
Figure 2B:
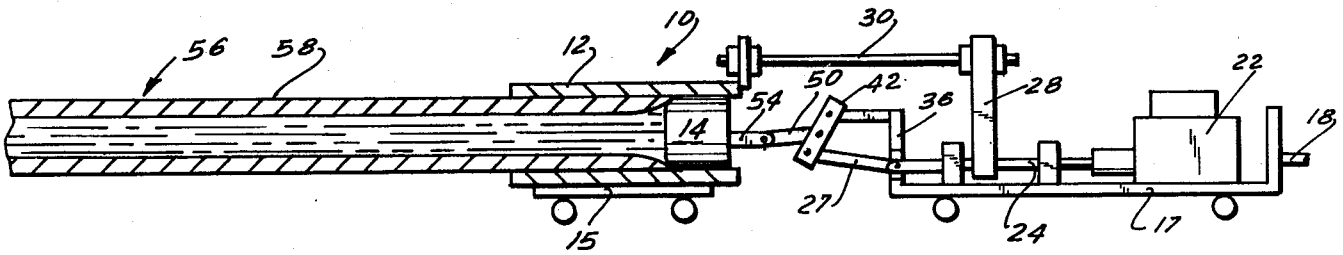
FIG. 2B is similar to FIG. 2A, showing a later stage of the operation.

Turning now to the mode of operation of the apparatus of FIG. 1 such as to tend to produce complete relief of strain or tension on the newly freezing skin portion at the rear end of the shell 57 upon the oscillatory movement of the axial wall 12 in a forward direction or in the casting direction, there is shown in FIG. 2A a condition of the apparatus similar to that in FIG. 1 wherein the parts of the apparatus are shown in an arbitrary starting position for the purpose of illustrating this mode of operation. As shown in FIG. 2B, the carriage 17 has moved rearwardly from the position of FIG. 2A, through movement of the bar 18, while the piston rod 24 has effected a forward oscillatory movement of both the axial mold wall 12 and mold plug 14 on the carriage 15 to their respective extreme forward oscillatory positions during the same oscillatory time period but to different positions relative to each other. In other words, in FIG. 2B, the axial wall 12 has moved forwardly a greater distance than the plug 14 has moved through the above-described linkage connected to the piston rod 24, including the link 27, the link 42 and the link 50. The oscillatory velocity of the plug 24 is slower than the axial wall 12 in this mode.

Figure 2C:
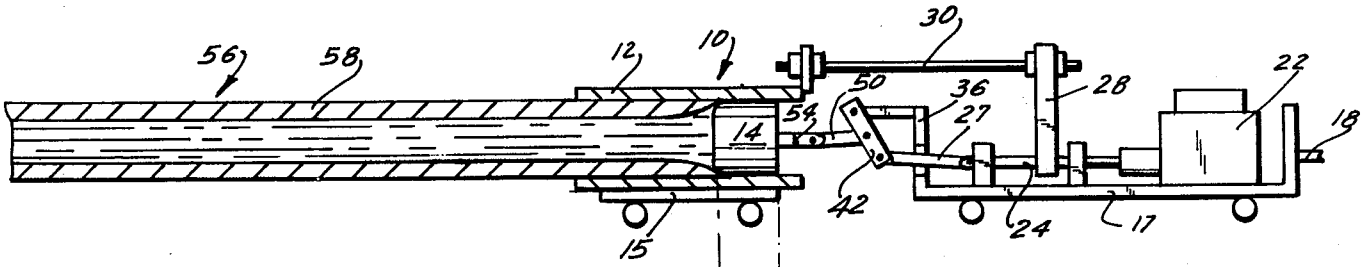
FIG. 2C is a view similar to FIG. 2B but illustrating a subsequent stage of operation.
Figure 2D:
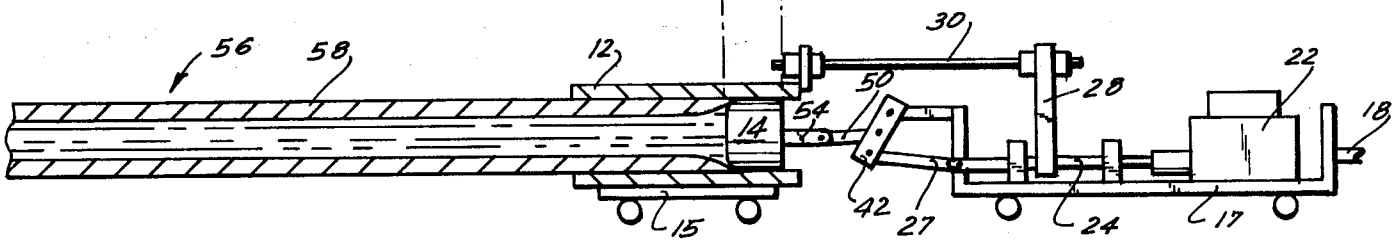
FIG. 2D is a view similar to FIG. 2C but illustrating a subsequent stage of operation, in which the aforementioned strain is reduced in the casting operation utilizing the apparatus of FIG. 1.

On comparison of FIGS. 2B and 2C, it will be observed that the carriage 17 has been drawn rearwardly a distance from that shown in FIG. 2B pulling the carriage 15 a distance while the piston rod 24 has been retracted. Such retraction on such movement of the carriage 17 to the position of FIG. 2C effects oscillatory movement of the axial wall 12 to its extreme rearward position through the aforementioned tie rods 30, and simultaneously moves the plug 14 to its extreme rearward position through the above-described linkage. As the carriage 17 is drawn to the right as shown in FIG. 2A from the position of FIG. 2A to that of FIG. 2C, the initial rear end 57 of the shell 59 is moved (not shown because of the relatively small scale of the drawings) within the axial wall 12 in the casting direction and there is an area of newly freezing metal between the initial rear end 57 of the shell shown in FIG. 2A and the plug 14. On comparison of FIGS. 2C and 2D, it will be observed that the carriage 17 has moved rearwardly from the position of FIG. 2C while the wall 12 and the plug 14 have been oscillated to their relative extreme forward positions. However, it will be noted that the plug 14 has not moved from its position with reference to nonillustrated ground as shown by a comparison of FIGS. 2C and 2D. This position of the plug 14 relatively to the axial wall 12, owing to the position of the pivot 48 in the selected pivot hole 44 of FIG. 1, and the distance of the aforementioned forward oscillatory movements with reference to the distance of withdrawal of the carriage 17 in the same interval of time relieves the strain or tension on the newly freezing metal. It is to be understood that as the casting issues from the exit end of the mold 10, nonillustrated cooling jets of water impinge on the casting 56. In this mode of operation, in the form illustrated by way of example, the relief of strain on such newly freezing metal during such period is essentially complete, that is, there is essentially no tension on such newly freezing metal during the forward oscillatory movement of the axial wall 12, during the time interval required for the carriage 17 to travel forwardly from the position of FIG. 2C to the position of FIG. 2D. It will also be evident from the description of FIGS. 2A–2D that during the operation of the apparatus of FIG. 1 in this mode, that the carriage 17 is moved rearwardly per unit of time a lesser distance than the distance of the plug in its rearward oscillatory motion. In the form of the invention illustrated in FIG. 1, the oscillation of both the axial wall 12 and the plug 14 is of a sinusoidal character. The internal surface of the wall 12 may taper to open in a forward or casting direction as in my U.S. Pat. No. 3,857,437. Purely by way of illustration and not in any limiting sense, in this mode of operation wherein the oscillatory cycle of the wall 12 and the plug 14 is constituted by one forward movement and one rearward movement of each between extreme positions, the oscillation frequency may be 150 cycles per min. The distance of travel of the wall 12 per cycle may be 0.5 in., while the distance of the movement of the plug 14 may be 0.25 per cycle, and the carriage withdrawal may be 60 in. per min., purely by way of example only for the purpose of illustrating this mode of operation, and not by way of limitation.

In accordance with the foregoing, the strain relief of of the metal newly freezing on the wall 12 during the forward oscillatory movements of the wall 12 and the plug 14 is such as to reduce or essentially eliminate hot tearing of the solidifying billet skin or shell 59. It is well known in the art that hot tearing not only effects the quality of the billet cast but may also be of such magnitude as to cause, not just damage to the solidifying billet skin, but complete rupture of the skin. Such a rupture not only necessitates cessation of the casting operation in most if not all instances, but is extremely hazardous to persons in the area of the casting apparatus during such a casting operation. However, it is not essential that such strain relief or tension be complete to eliminate hot tearing, and in fact, such strain relief may be more than complete as will appear hereinafter wherein a mode of operation of the apparatus is described with reference to FIGS. 3A–3D wherein such strain relief is negative and a relatively small degree of compression or force in a compressive direction is imposed on the metal newly freezing on the wall 12 on forward oscillatory movement of the latter.

Reverting to the mode of operation to relieve strain on such metal newly freezing on the axial wall 12 rather than place it in compression, the strain relief may be less than complete, as previously indicated, and by way of example and not by way of limitation, the oscillation frequencies of the wall 12 and the plug 14 may be 125 cycles per min., the distances of travel of the wall 12 and the plug 14 0.5 in. and 0.25 in. per cycle, respectively, and the distance of carriage withdrawal may be 60 in. per min.

As previously indicated, in the mode of operation of the apparatus of FIG. 1 illustrated in FIGS. 3A–3D, not only is any strain on the metal newly freezing on the wall 12 during the forward oscillating movements relieved, but such newly freezing metal is slightly compressed, meaning that the last-mentioned metal is placed under pressure, by relative forward movement of the plug 14 with reference to the casting 56 to the extent of, perhaps, 0.025 in., which figure is given solely for the purpose of understanding this mode of operation and not for practical purposes. This compression of the newly freezing metal by the plug 14 is clearly indicated in FIG. 3D when compared to FIG. 3C, wherein FIGS. 3A–3D correspond to FIGS. 2A–2D respectively as to relative movements of the carriage 17, the mold wall 12 and the plug 14.

As shown by a comparison of FIGS. 3C and 3D, in the latter the plug 14 is a distance X forward of the plug position in FIG. 3C. Purely for the purpose of understanding this mode of operation and not for the purposes of setting forth critical requirements, the axial wall 12 and the plug 14 may be moved 0.5 and 0.25 in. per cycle, respectively, and oscillated at a frequency of 225 cycles per min. while the rearward movement of the carriage is 60 in. per min. It is to be noted that the oscillating velocity of the plug 14 in this mode of operation is slower than the velocity of the plug 14 in this mode of FIG. 2A. With reference to both the modes of FIGS. 2A and 3A the frequency of the oscillation of the plug 14 may be the same as or an even multiple of the frequency of the oscillation of the wall 12 with a nonillustrated different oscillation mechanism of conventional design. For example, with respect to such a multiple, the frequency of oscillation of the mold wall 12 may be twice the frequency of the oscillation of the plug 14.

In the modified form of the apparatus shown in FIGS. 4A–4D, the axial wall 66 of the mold 10 is open-ended, and in these views there is shown a tundish, indicated generally at 68, which is shown as having a level of molten metal 60 which may decrease during a casting operation. The tundish 68 has the usual nozzle or plug 72 fixed thereto through which the molten metal in the tundish 68 flows into the axial wall 66 which is chilled in a conventional, nonillustrated manner and oscillated, preferably in a sinusoidal manner, by a conventional, oscillating mechanism having an output armm 69 connected to the wall 66. In this form, not only does the mold wall 66 oscillate as aforesaid, but the tundish 68, which is supported, by non-illustrated conventional apparatus, to be slidable forwardly and rearwardly with reference to the casting 56, is also oscillated from a part of the same mechanism oscillating the wall 66 (or a separate oscillating mechanism) through an output arm 74 connected to the tundish, in a manner shown successively in FIGS. 4A–4D corresponding to the oscillating movements described with reference to FIGS. 2A–2D, respectively, but different in the sense that as illustrated in FIGS. 4A–4D, the casting direction is not in a direction toward the source of the molten metal but is in a direction away from the source of the molten metal, and the casting issues in a forward direction, the mold being indicated generally at **10*a*. As in the form of FIGS. 2A–3D, the relief of strain or tension on the metal newly freezing on the wall 66 takes place on the oscillating movement of the wall 66 in a direction toward the source of molten metal. As in the mold operations previously described, nonillustrated cooling jets of water impinge on the casting 56 as it issues from the mold 10*a* drawn by a pair of pinch rolls 76 which may be driven by a conventional nonillustrated mechanism in a manner such that the casting 56 is moved in a forward direction at an average casting rate. In the nonillustrated commencement of the casting operation, a dummy bar may be utilized in the conventional manner to withdraw the casting 56 within the axial wall of the mold 10, which dummy bar is itself moved by the pinch rolls 76**.

As shown in FIG. 4A, the oscillating axial wall 66 and tundish 68 are in their middle oscillatory positions corresponding to FIG. 2A. From these positions, the axial wall 66 and the tundish 68 are moved to their forward oscillatory positions shown in FIG. 4B during the withdrawal of the casting 56, and while this is taking place metal newly freezes on the axial wall 66 in a portion of the area indicated by the broken line 78, extending from the nozzle 72 forwardly to the initial rear end 57 of the casting 56 which end is shown as it existed in FIG. 4A. The entire area 78 is an area of metal solidifying. In FIG. 4C it can be seen that both the axial wall 66 and the tundish 68 have moved from their positions of FIG. B to the extreme rearward positions thereof. It can be seen further that during these oscillatory movements of FIGS. 4B and 4C, the tundish 68 moves a lesser distance than the axial wall 66. On a comparison of FIGS. 4C and 4D, it will be seen that in FIG. 4D, the plug 72 has moved a distance Y from the position of FIG. 4C to the position shown in FIG. 4D and that the casting or billet 56 has moved an equal distance Y, whereby relief of strain or tension on the metal newly freezing on the axial wall 66 is complete. In FIG. 4D, it will be noted that both the axial wall 66 and the tundish 68 have both oscillated from the position of FIG. 4C to their extreme forward oscillatory positions while there is an area of metal newly freezing to the axial wall 66 during the withdrawal of the casting 56 from the mold **10*a*. It is to be noted that the apex of the solidification zone, designated with reference numeral 80, is always the same distance from the pinch rolls 76**.

Turning now to the operation of the apparatus of FIG. 4A in the mode of operation of FIGS. 5A–5D, FIGS. 5A–5D correspond respectively with FIGS. 4A–4D. However, in this mode, when the plug 72 has been moved from the position of FIG. 5C to the position of FIG. 5D, the casting during this plug movement has moved a distance Z′ which is a lesser distance than the distance Z which the plug 72 is moved thereby indicating a compressive force of the plug 72 on the metal newly freezing to the axial wall 66.

With reference to the modes of operation of the apparatus shown in FIG. 4A, which modes are illustrated in FIGS. 4A–4D and 5A–5D, the distance of oscillatory movement (in the mode of FIGS. 4A–4D) of the axial wall 66 per cycle as previously defined is 0.50 in. while the distance of oscillatory movement of the tundish 68 in the same cycle is 0.25 in., the wall 66 and the plug 72 are oscillated at a frequency of 150 cycles per min., solely for the purpose of understanding the invention and by way of illustration. Further, in this example, the distance of withdrawal of the casting per cycle is 60 in. per min. In the mode of operation shown in FIGS. 5A–5D, the distance of oscillatory movements of the axial wall 66 per cycle is 0.50 in., the distance of the oscillatory movements of the tundish 68 is 0.25 in., while the distance of withdrawal of the casting is 60 in.

per min., and the tundish 68 and wall 66 are oscillated at a frequency of 225 cycles per min., solely for the purposes of understanding this mode of operation and by way of illustration.

In the form of the invention shown in FIG. 6, a stationary tundish 82 has as a fixed part thereof nozzle or plug 84 which nozzle has a forward end portion which may be constructed in accordance with my U.S. Pat. No. 3,857,437 wherein there is a portion 86 through which molten metal flows into the mold **10*b*, which portion 86 is formed of refractory material. Radially outwardly thereof is a seal 88 bearing against the internal surface of the axial wall 90 of the mold 10*b*. The axial wall 90 is open-ended. The axial wall 90 is oscillated by a conventional mechanism through an output arm 91, preferably in a sinusoidal manner. The casting 56 is withdrawn from the mold 10*b* by a pair of pinch rolls 92 engaging the casting 56**.

These rolls 92 are driven in a manner to periodically withdraw the casting 56 and at intervals reverse the direction of the casting 56, that is move it in the direction of the plug 84. The drive mechanism for the casting or billet for this manner of operation of the pinch rolls 92, may be a conventional drive mechanism. However, it is to be clearly understood from the foregoing that the applicant is not stating that a casting has been oscillated heretofore. It is also to be understood from the foregoing that while the pinch rolls 92 oscillate the casting 56 in the aforesaid manner, the rolls 92 additionally withdraw the casting 56 from the mold. In other words, at the end of each forward oscillatory movement of the billet 56 the pinch rolls 92, without interruption of operation, move the casting 56 in the casting direction an additional distance.

The mode of operation of the apparatus of FIG. 6 is such that the oscillatory movement of the axial wall 90 per cycle as previously defined is 0.50 in., the oscillatory movement of the casting 56 per cycle is 0.25 in., while the distance of withdrawal of the casting 56 (not including the forward oscillating movement thereof) is 60 in. per min., and the frequency of oscillation of the wall 90 and the billet 56 is 150 cycles per min., solely for the purpose of explaining one mode of operation of the apparatus of FIG. 6 and not for practical purposes. The direction of drive of the pinch rolls 92 is reversed to move the casting 56 toward the tundish 82 a lesser distance than the distance of movement of the axial wall 90, thereby relieving strain or tension on the metal newly freezing to the axial wall 90. Such mode of operation may be likened to that illustrated and described with reference to FIGS. 2A–2D and the mode of operation of FIGS. 4A–4D. Moreover, the mode of operation of FIG. 6 may be such as to completely relieve strain and induce or impose a compressive force on the metal newly freezing on the axial wall 90 during the rearward oscillatory movements of the axial wall 90 and the casting 56 in a manner likened to that previously described with reference to FIGS. 3A–3D and 5A–5D. Again, solely for the understanding of the last mentioned mode of operation of the apparatus of FIG. 6 of the invention and not for practical purposes, the oscillatory movements of the axial wall 90 per cycle may be 0.50 in., the oscillatory movements of the casting 56 may be 0.25 in. per cycle, and the casting or withdrawal rate may be 60 in. per min., while the wall 90 and the billet 56 are oscillated at a frequency of 150 cycles per min.

In the modified form shown in FIG. 7, somehat similar to the form of FIG. 1, like parts are designated with like reference numerals. The carriage 17 at its end nearest the carriage 14 has an upright standard 94, similar to the standard 36 previously described, through which the piston rod 24 operates with clearance. As shown in FIG. 7, the distal end of the piston rod 24 is connected by the pivot 46 to an elongated link 96, similar to the link 42 previously described, but which is connected intermediate of its end by the pivot 40 to an arm 98 integral with the standard 94 and extending forwardly therefrom as shown. The plug 14 has projecting rearwardly therefrom in fixed relation stub shaft 98, similar to the stub shaft 54 previously described, which is pivoted by the pivot 48 directly to the end of the link 96 remote from the end thereof connected to the piston rod 24. From the foregoing, it will be apparent that when the piston rod 24 is extended from the position shown in FIG. 7 the axial wall 12 of the mold is moved forwardly to the broken line position thereof while the plug 14 is moved rearwardly a lesser distance to the broken line position thereof. If desired, the oscillating drive mechanism for the plug 14 may be completely separate from the oscillating drive mechanism for the axial wall 12, as in the form of FIG. 1 if such is desired in the apparatus of FIG. 1. With reference to the oscillation of the apparatus of FIG. 1, as previously described it can be seen that in the form of FIG. 7 the oscillatory movements of the axial wall 12 and plug 14 are 180 degrees out of phase. In the operation of the apparatus of FIG. 7, it is to be noted that while, during the oscillatory movement of the axial wall 12 in the casting direction, strain or tension may be imposed on the metal newly freezing to such axial wall owing to the movement of the plug 14 in the opposite direction. During the oscillatory movement of the axial wall 12 in the opposite direction, that is, opposite the casting direction, strain is relieved on such newly freezing metal in a manner to effectively tend to prevent hot tearing of the skin or shell 58 of the casting, or to repair any damange done to such skin or shell by the first-described oscillatory movements of the axial wall 12 and the plug 14. During the movement of the axial wall 12, away from the casting direction, and the movement of plug 12 in the casting direction, the plug 14 serves to back up such metal newly freezing on the axial wall to relieve strain and tension thereon or to produce negative strain or a compressive force on such newly freezing metal.

In the modified form shown in FIG. 8, somewhat similar to the form of FIG. 4A, like parts are designated with like reference numerals. The form of FIG. 8 differs from the form of FIG. 4A in that the axial wall 66 of the mold **10*a* is oscillated through the input 69 in the direction of the tundish 68 during the time that the latter is being oscillated in the casting direction through the input 74. It may be noted that the effect on the billet 56 being formed in the mold 10*a* with reference to stress relief or compressive force on the billet through the nozzle or plug 72 may be identical to those described with reference to the operation of the apparatus of FIG. 7**. Moreover, it may be noted here that in both forms, the oscillation of the axial mold wall and the plug may be such that the direction of one of the elements, say the plug, may be reversed while the oscillatory movement of the other element, say the axial wall, is in one direction only.

While several forms of method and apparatus of the invention have been described, it will be apparent, especially to those versed in the art, that such method and apparatus may take other forms and are susceptible to various changes in details without departing from the principles of the invention.

What is claimed is:

1. A method of continuous casting of a metal billet element, comprising the steps of: introducing molten metal from a source of molten metal into an axial wall mold in which there is a plug element, cooling said axial wall mold for solidifying molten metal therealong, the skin portion of said billet element being newly formed adjacent said plug element, withdrawing said billet element from said mold, oscillating said axial wall mold, and concurrently relatively oscillating one of said elements with respect to said oscillating axial mold wall, to reduce tension on said newly formed skin portion during the oscillatory movement of said axial wall mold and while withdrawing said billet element from said axial wall mold.

2. A method as defined in claim 1, comprising the further step of: oscillating said axial wall mold a greater distance than said one element.

3. A method as defined in claim 1, comprising the further step of: oscillating said axial wall mold and said one element in correlated relation.

4. A method as defined in claim 3, comprising the further step of: oscillating said axial wall mold and said one element in phased relation.

5. A method as defined in claim 3, comprising the further step of: oscillating of said axial wall mold and said one element at least in part in opposite direction.

6. A method as defined in claim 1, comprising the further step of: oscillating said wall and said one element, at least in part, at different velocities.

7. A method as defined in claim 1, comprising the further step of: introducing said molten metal into said axial wall mold through said plug element while oscillating said one element.

8. A method as defined in claim 7, wherein said plug element is attached to said source of molten metal, and including the further step of oscillating said source to displace said plug element.

9. A method as defined in claim 1, comprising the further step of: closing one end of said axial wall mold with said plug element during oscillation of said one element.

10. A method as defined in claim 1, comprising the further step of: oscillating said axial wall mold and said one element in sinusoidal fashion.

11. A method as defined in claim 1, comprising the further step of: oscillating said axial wall mold and said one element independently.

12. A process for continuously casting an elongated metal article, comprising the steps of:

a. introducing molten metal from a source of molten metal into a movable mold having an axial wall mold structure and an end plug structure relatively movable in the mold and defining a variable mold cavity;

b. cooling said axial wall structure of the mold for solidifying molten metal there along;

c. relatively withdrawing the mold from the source of molten metal to form a solidified casting shell of said article extending from said source of molten metal to said mold with a molten core, molten metal from said core flowing through the center of said article within the solidified shell towards the end plug of the mold during casting; and d. relatively oscillating both the axial wall mold structure and the end plug structure with respect to one another whereby compression in the molten metal and its solidification can be selectively controlled.

* * * * *